United States Patent [19]

Simons

[11] 4,408,763

[45] Oct. 11, 1983

[54] GAMEBOARD AND CARRYING CASE

[76] Inventor: Charles R. Simons, 19 W. Thompson Ave., Pleasantville, N.J. 08232

[21] Appl. No.: 350,617

[22] Filed: Feb. 22, 1982

Related U.S. Application Data

[63] Continuation-in-part of Ser. No. 236,720, Feb. 23, 1981, Pat. No. 4,381,113, which is a continuation of Ser. No. 952,311, Oct. 11, 1978, Pat. No. 4,252,324, which is a continuation-in-part of Ser. No. 748,820, Dec. 9, 1976, abandoned, which is a continuation-in-part of Ser. No. 674,986, Apr. 8, 1976, abandoned.

[51] Int. Cl.[3] ..... A63F 3/00

[52] U.S. Cl. ..... 273/286; 206/315.1

[58] Field of Search ..... 273/285, 286, 287

[56] References Cited

U.S. PATENT DOCUMENTS

| | | | |
|---|---|---|---|
| 34,168 | 1/1862 | Small | 273/286 |
| 509,316 | 11/1893 | Lapham | 273/286 |
| 1,266,857 | 5/1918 | Recker | 273/285 |
| 1,903,798 | 4/1933 | Turner | 229/93 |
| 3,838,857 | 10/1974 | Busby | 273/287 |
| 4,183,432 | 1/1980 | Lemaire | 206/0.82 |
| 4,252,324 | 2/1981 | Simons | 273/286 |

FOREIGN PATENT DOCUMENTS

| | | | |
|---|---|---|---|
| 2610112 | 9/1977 | Fed. Rep. of Germany | 273/286 |
| 1501915 | 10/1967 | France | 273/286 |
| 2223956 | 10/1974 | France | 273/290 |
| 1385889 | 3/1975 | United Kingdom | 273/290 |

*Primary Examiner*—Richard C. Pinkham
*Assistant Examiner*—Scott Brown
*Attorney, Agent, or Firm*—Robert L. Stone

[57] ABSTRACT

A gameboard and carrying case wherein the gameboard is of pliable material, such as leather, so that it is adapted to be rolled into a roll and a carrying case for the gameboard which receives the gameboard when in a rolled condition and in which there are also received within the roll of the gameboard in the bore of that roll, the playing pieces which are stored in an openable receptacle which when closed is cylindrical in shape and of circular configuration throughout its axial length, said receptacle being sized to nest said play pieces therein.

6 Claims, 8 Drawing Figures

GAMEBOARD AND CARRYING CASE

This application is a continuation-in-part of application Ser. No. 236,720, filed Feb. 23, 1981, now U.S. Pat. No. 4,381,113, which is a continuation of application Ser. No. 952,311, filed Oct. 11, 1978, now U.S. Pat. No. 4,252,324, issued Feb. 24, 1981, which is a continuation-in-part of application Ser. No. 748,820, filed Dec. 9, 1976, now abandoned, which is a continuation-in-part of application Ser. No. 674,986, filed Apr. 8, 1976, now abandoned.

FIELD OF THE INVENTION

This invention relates to games and, more particularly, to a combination of a gameboard of pliable material rolled into a roll and stored in a carrying case and a gamepack which holds and stores the play pieces.

BACKGROUND OF THE INVENTION

As is perhaps well known, games such as checkers, chess and backgammon are quite common; however, it is often times inconvenient to carry them. This invention is of a container for receiving, transporting and carrying such a gameboard, the play pieces and the game pack for the play pieces when not in use.

In the preferred embodiment, the gameboard is of pliable leather or plastic material, as is the container. Indicia on the gameboard surface may be applied by the silk screen method or any other suitable manner of applying indicia on a gameboard. There is thus provided a richly textured soft leather or plastic gameboard and a carrying case to receive it which is of high fashion, is compact for storage, and may be readily transported from one playing location to another; and it is of a long-lasting structure and materials and maintains the play pieces together with the gameboard in a convenient fashion, the play pieces being stored within a gamepack as is described more fully hereinafter.

In accordance with these general objects, the instant invention will now be described with reference to the accompanying drawings in which:

DESCRIPTION OF THE PREFERRED EMBODIMENT

Figure 1:
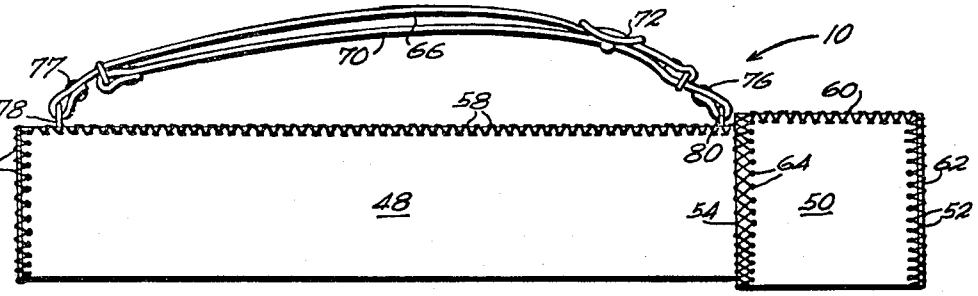
FIG. 1 is a side elevation view of a container for the gameboard according to this invention.
Figure 2:
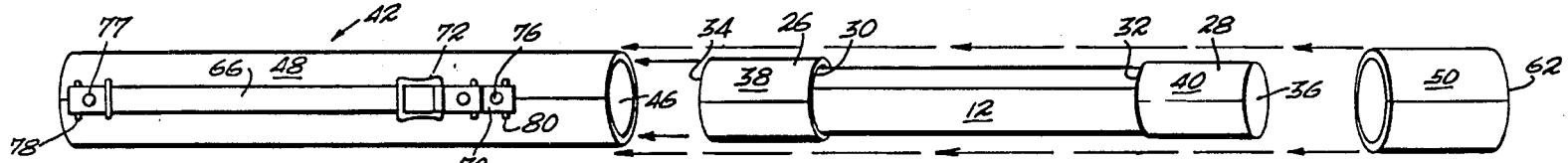
FIG. 2 is an exploded perspective view of the combination shown in FIG. 1.
Figure 3:
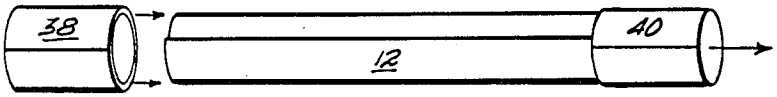
FIG. 3 is a partially exploded view of the gameboard in a rolled condition with end caps.
Figure 4:
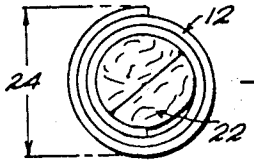
FIG. 4 is an end view of the rolled gameboard shown in FIG. 3 with one of its end caps removed.
Figure 5:
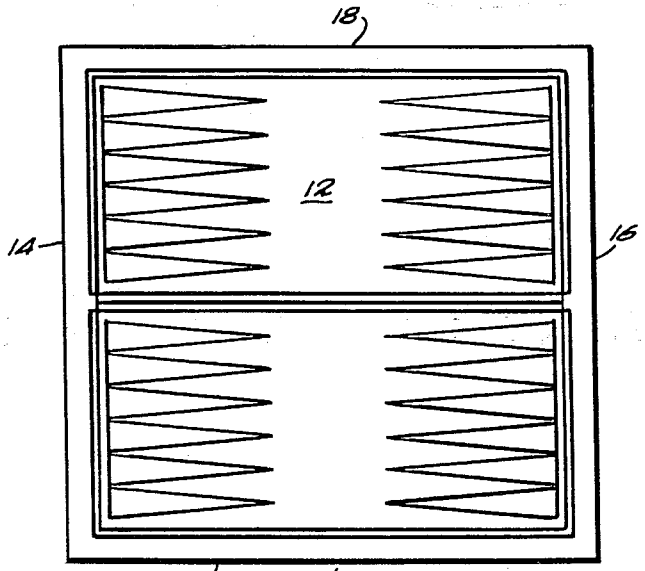
FIG. 5 is a plan view of a pliable gameboard in accordance with this invention.

Referring to the drawings wherein like reference characters designate like or corresponding parts throughout the several views, the numeral 10 in FIG. 1 generally designates the container and gameboard. Referring to FIG. 5, the gameboard is shown and there designated by the numeral 12. It is seen that it includes a planar member, which is of pliable material. Thus, it is adapted to be rolled up into a roll with the edges 14 and 16 being parallel to the axis of the roll. The opposing edges of the gameboard are designated 18 and 20, generally rectangular. In the preferred embodiment illustrated, it is a backgammon gameboard of geometrical design having four equivalent qudrants, each with 6 equally spaced points, although it might, alternatively comprise a chess board or a checkerboard or a backgammon gameboard may appear on one side and a chess board or checkerboard on the other. As seen in FIG. 2, the gameboard when rolled is capped at the opposite ends by the end caps 26 and 28. The end caps serve as dice cups, for example, when playing backgammon. When the gameboard is rolled there is a bore or long hole 22 through it. The overall outside diameter of the roll, as indicated in FIG. 4, is designated by the numeral 24. The diameter is sized to be received within the recesses 30 and 32 of the end caps 26 and 28 which are composed of end walls 34 and 36 and side walls 38 and 40. The capped gameboard in the rolled condition is adapted to be received within the container 42 defining a receptacle interior designated by the numeral 46 bounded by the side walls 48 and, when inserted therein, the container is capped by an end piece 50 which has an opening 54 sized to receive the end of the container, as shown in FIG. 1. The container 42 is typically about 1 inch (i.e. about 2.5 cm) longer than the length of edges 18 and 20 of the gameboard. The capped gameboard rests in the capped container snugly but with a small area of freedom so that when the gameboard is withdrawn from the container as indicated in FIG. 2, end cup 26 is not prone to fall off in the interior 42 of the container 26. In the embodiment illustrated the end wall 62 is stitched to the side walls, see FIG. 1, and stitched together as at 60. Additionally, in this embodiment, the container in chief 42 is stitched together and may be formed of leather, the stitching being designated by the numerals 51 and 58. The container may include a carrying strap generally designated by the numeral 66 with elongate length 70 folded back upon itself in a conventional manner and provided with adjustment buckle means 72 and connecting means 76 and 77 to connect to U-shaped brackets 78 and 80 on the exterior of the container.

Figure 6:
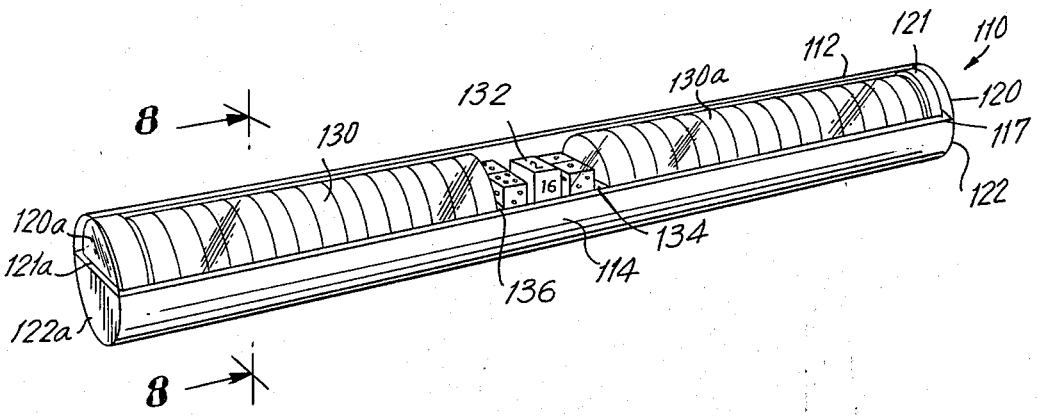
FIG. 6 is a view of a gamepack comprising an openable receptacle having playpieces nested therein in closed position.
Figure 7:
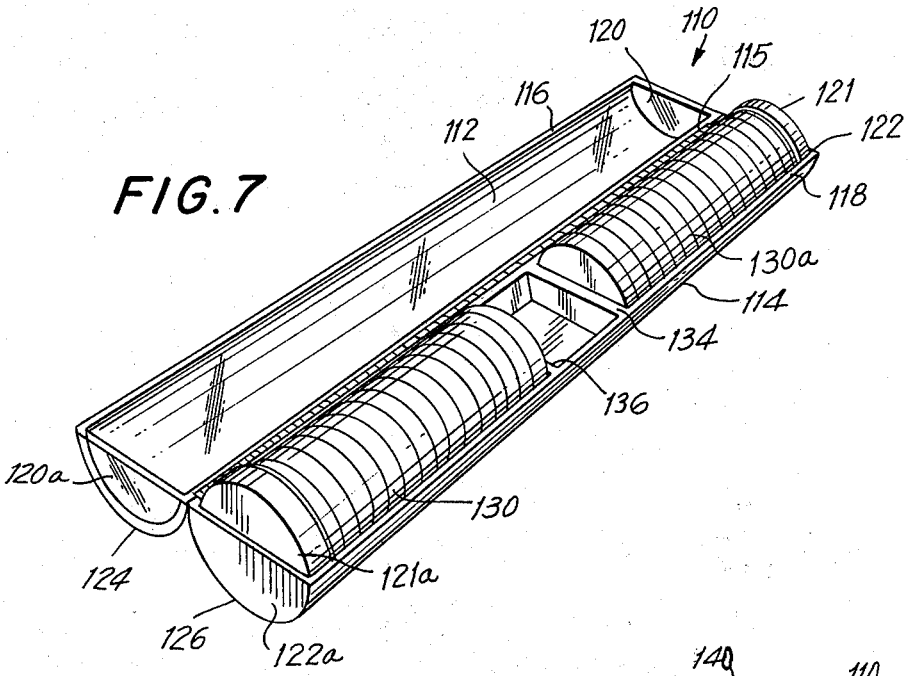
FIG. 7 is a view of the gamepack with the receptacle open to form a tray.
Figure 8:
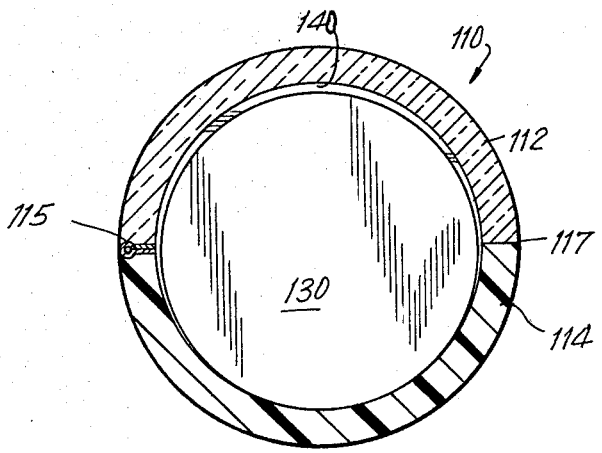
FIG. 8 is a view in cross section taken on the plane indicated by the line 8—8 of FIG. 6 and looking in the direction of the arrows.

As seen in FIGS. 6, 7 and 8 the gamepack comprises an openable receptacle 110 of a length about the same as but a little less (e.g. about 1 inch) than the distance across the gameboard edges 18 and 20 (FIG. 5).

Openable receptacles for purposes other than gamepacks are known, for instance in U.S. Pat. No. 4,183,432 to Lemaire as a coin holder (particularly FIGS. 5–8); U.S. Pat. No. 728,407 to Paterson as a mailing tube; and U.S. Pat. No. 366,075 to Chope as a money package.

The receptacle of the present invention is particularly proportioned for use as a gamepack in the combination of the present invention. The openable receptacle 110 contains two corresponding portions 112 and 114 joined together at means for a closure, such as at hinge rib 115, on the axial length of the receptacle, which facilitates juxtaposition of the portions 112 and 114. Portions 112 and 114 are desirably formed of rigid plastic material and preferably at least one portion (e.g. 112) is transparent.

Opposite the hinge rib 115, at an angle 180° therefrom are edge strips 116 and 118 of each of portions 112 and 114, respectively, along the axial length of the receptacle, best viewed in FIG. 7. When the portions are brought together, edge strips 116 and 118 meet firmly along a seam 117 in a manner such that the receptacle remains closed until subjected to mild pressure, such as finger pressure to move the portions apart. The firmness of the closure seam 117 may result form pressure of closing at the hinge rib 115. Optionally, it can be supplemented by interlocking protrusions or ridges and the like at the edge strips (not shown).

As an alternative to hinge rib 115, along the axial length of the receptacle, clip, tape, arms spring or other like means (not shown) may be employed to connect the two portions of the receptacle.

Each of the portions 112 and 114 has end walls 120, 122, 120*a* and 122*a* which also close and reinforce the firmness of the closure when edge strips 116 and 118 are brought together. Optionally end walls 122 and 122*a* may have an upwardly extending indented semi-circular part against which end walls 120 and 120*a* can slide during closing. Whe the receptacle is open, the two protions rest on the surface 124 and 126 of each, equidistant from the hinge rib and edge strips, so that the receptacle becomes a tray, illustrated in FIG. 7, into which the game pieces may be placed.

When closed, the receptacle 110 is essentially a closed tube and is adapted for placement inside the bore 22 of rolled gameboard 12 (FIG. 4). At least one of the receptacle portions contains at least two and preferably three divisions. The divisions are sized such that the game pieces normally characterized as "men" 130 and 130 a can be equally divided in two divisions. Men 130 are typically of different color than men 130*a*. Additional game pieces 132, such as dice, can be placed in a third and smaller division, typically centrally located. The divisions are separated by walls 134 and 136. The longer divisions are preferably each sized to accommodate 16 men, a total of 32, the number required for checkers of chess and two more than that required for backgammon. The divisions for men 130 and 130*a* are sized so that these game pieces can stand snugly nested in the portions. Cover members 121 and 121*a* may be provided adjacent to end walls 122 and 122*a* to facilitate standing men 130 and 130*a* in the divisions for each. The men are desirably sized such that when placed on the backgammon game board 12 they fit in touching juxtaposition covering the base of each point of the backgammon board. Thus, the field of the backgammon board has an interrelationship with the size of the men and the width of the base of each point, which also relates to the axial length of the outer container 42, which may be illustrated in the following Table:

TABLE

| Width of base of each backgammon point | Diameter of each man | Length of field (edges 18 and 20) of gameboard 12 | Axial length of Container 42 |
|---|---|---|---|
| ¾ in. | ¾ in. | 12 in. | 13 in. |
| 1 in. | 1 in. | 15 in. | 16 in. |
| 1¼ in. | 1¼ in. | 18 in. | 19 in. |

For every increase of ¼ inch in the width of the base of each point and the diameter of the men, the length of the field increases by 3 inches with the axial length of the container increasing by 1 inch over that.

The width of the men 130 and 130*a* is such that when placed in the divisions for each with additional division space provided for dice 132, the axial length of the openable receptacle 110 is up to equal to, preferably about ½–2 inches shorter than, the length of edges 18 and 20 of the game board 12.

The inside circumference of the openable receptable when portions 112 and 114 are closed upon themselves is such that it is just slightly greater (e.g. about 1/16–⅛ inch), shown at 140 in FIG. 8, than the diameter of a typical "man" 130. This permits the men to nest snugly in the receptacle when it is closed with only a minor degree of movement possible and does not provide adequate room for the dice 132 or any other game pieces to substantially move with the gamepack when it is closed for enclosure within the carrying case.

The gameboard 12 is snugly rolled around the outside circumference of the receptacle 110 when closed for placement within the carrying case 42. When the gameboard 12 is rolled around the receptacle 110, its diameter is such that it is sized to receive the dice cup end caps 26 and 28.

It is thus seen that there is provided a compact package of a rolled gameboard 12 capped at the ends which are sized for snug receipt within the bore 46 of container 42 and capped and in the rolled bore 22 of which the game pieces 130, 130*a* and 132 may be stored in an openable receptacle 110 and which as a combination may be readily carried by the carrying strap 66; and that the end caps 26 and 28 of the gameboard also serve as dice cups.

The longitudinally extending seams 58 of the case 48 and 60 of the end piece 50 and of the end caps 38 and 40, as at 59 and 61, may be somewhat elastic so that the butted end of the pliable material, joined by the respective seams, are somewhat yieldable with respect to one another for minor movement of adjustment when not rolled exactly correctly for ease in packaging of the combination when not in use.

What is claimed is:

1. In combination, a carrying case, a gameboard, a pair of die tossing cups, play pieces and a game pack for storing the play pieces, said gameboard comprising a sheet of pliable material of uniform thickness having a first and a second pair of opposed right-angularly arranged margin edges spaced from one another a first and a second predetermined distance respectively, and each edge being of said uniform thickness, said gameboard being rolled into a roll and defining a bore of generally circular cross section throughout its length, said length being of a length equal to said first predetermined distance;

said pair of die tossing cups comprising a first and second end cap, said first end cap and said second end cap each having an open end and including a closed circular end wall and a cylindrical axially extending side wall of circular cross section of a predetermined inner diameter substantially equal to the diameter of said gameboard when rolled and each of said end caps including said side walls and end walls being of a common predetermined outer diameter, and each of said end caps being positioned on the ends of said rolled gameboard with the end wall of each cap being in abutting engagement with one of the margins of said gameboard along said second pair of opposed edges and captivated within said end caps and within said axially extending side walls of said end caps, each of said end caps being of an axial length substantially less than one-half the distance between said second pair of opposed edges; and said carrying case comprising a longitudinally-extending tubular container of circular cross-section of an inner diameter substantially equal to but slightly greater than the outer diameter of the cylindrical side walls and end walls of the end caps, said case having a closed end and an open end, and said gameboard and end caps being in said container, said container snugly jacketing said gameboard and end caps, said container being of an axial length substantially equal to but slightly greater than the first predetermined length of same gameboard and the thickness of the end walls of said first and second end caps and said container having an outer uniform diameter said container being comprised of a formed sheet of pliable material of uniform thickness;

cap means for said open end of said tubular container, said cap means comprising a cup-shaped member of a diameter substantially equal to said outer diameter of said container and having an axially extending skirt sized to and snugly jacketing said container adjacent said open end and closing said open end of said container; and said game pack comprising an openable receptacle of rigid plastic which when closed is essentially a closed tube, said receptacle comprising two corresponding portions joined together by closure means on the axial length of the receptacle being capable of closure along edge strips of each portion 180° from said closure means, said portions having end walls which reinforce the firmness of closure of the receptacle, there being present in at least one of said receptacle portions at least two divisions, said divisions being sized to hold play pieces all of which are sized and configured of non-interlocking configuration to be nested within said divisions such that the play pieces cannot substantially move except for axial movement within said receptacle when it is closed.

2. The device as set forth in claim 1 wherein three divisions are present in one portion of said receptacle of said game pack, two of said divisions being of corresponding size and sized to each contain nested therein 16 play pieces of corresponding size and the third of said divisions being sized to receive dice playing pieces.

3. The device as set forth in claim 1 wherein the closure means of said receptacle of said game pack are hinge means along the axial length of the receptacle.

4. The device as set forth in claim 1 wherein the longidtudinally extending tubular container and said first and second end caps are circumferentially yieldable through a minor range of adjustment and include elastic means.

5. The device as set forth in claim 1 wherein a carrying strap is provided comprising a strap having a first end and a second end and means to connect the first end and the second end at spaced points along said container.

6. The device as set forth in claim 5 wherein the carrying strap is of adjustable length.

* * * * *